US005466891A

United States Patent [19]

Freeman et al.

[11] Patent Number: 5,466,891

[45] Date of Patent: Nov. 14, 1995

[54] CONICAL COMPOSITE $SF_6$ HIGH VOLTAGE BUSHING WITH FLOATING SHIELD

[75] Inventors: Willie B. Freeman, Irwin; David S. Johnson, Greensburg, both of Pa.; Klaus B. Froehlich, Baden, Switzerland

[73] Assignee: ABB Power T&D Company Inc., Stamford, Conn.

[21] Appl. No.: 225,239

[22] Filed: Apr. 8, 1994

[51] Int. Cl.[6] ..... H01B 17/26

[52] U.S. Cl. ..... 174/142; 174/11 BH; 174/12 BH; 174/14 BH; 174/15.3; 174/19; 174/140 R; 174/143

[58] Field of Search ..... 174/142, 140 R, 174/141 R, 143, 144, 74 R, 19, 15.3, 11 BH, 12 BH, 14 BH

[56] References Cited

U.S. PATENT DOCUMENTS

| | | | |
|---|---|---|---|
| 2,732,419 | 1/1956 | Wilson | 174/142 X |
| 3,189,715 | 5/1962 | Jennings | 174/142 X |
| 4,228,318 | 10/1980 | Selsing | 174/73 R |
| 4,774,385 | 9/1988 | Toshima | 174/142 |
| 5,059,753 | 10/1991 | Hamm | 200/148 F |
| 5,170,885 | 12/1992 | Guenther et al. | 200/144 B |

OTHER PUBLICATIONS

J. R. Meyer et al., "$SF_6$ Circuit Breaker Technology Advancements", Sep. 1993.

W. B. Freeman et al., "Application of RTV–Composite Insulation to High Voltage Brushings", Apr. 1990.

"Evaluation of a New Protective Coating for Porcelain Insulators"; *IEEE Transactions on Power Apparatus and Systems*; vol. PAS–101; No. 12; Dec. 1982.

ABB Power T&D Company, Inc. Product Literature: "Vertical–Break Group–Operated Outdoor Disconnect Switches", Jul. 1991.

ABB Power T&D Company, Inc. Product Literature: "Type PM Dead Tank", Apr. 1991.

ABB Power T&D Company, Inc. Product Literature: "TTT7 Double Break Group–Operated Outdoor Disconnect Switches", Jun. 1991.

ABB Power T&D Company, Inc. Product Literature: "Type PM $SF_6$ Power Circuit Breaker", Mar. 1991.

*Primary Examiner*—Kristine L. Kincaid
*Assistant Examiner*—Cheryl R. Figlin
*Attorney, Agent, or Firm*—Woodcock Washburn Kurtz Mackiewicz & Norris

[57] ABSTRACT

The present invention provides a floating shield for a high voltage bushing. Preferably the bushing is conically shaped and has a composite housing for substantially optimizing the electrical performance of the bushing according to the invention. The floating shield is preferably suspended within the bushing housing by a supporting insulator placed in a low electrical stress region of the bushing. In a preferred embodiment, the supporting insulator is disposed between a ground grading shield and the bushing housing. The composite housing preferably provides a protective inner tube made of a fiber reinforced material and an outer silicone rubber housing having weather sheds formed in a helix on the surface of the housing.

18 Claims, 8 Drawing Sheets

CONICAL COMPOSITE $SF_6$ HIGH VOLTAGE BUSHING WITH FLOATING SHIELD

FIELD OF THE INVENTION

The present invention relates to high voltage bushings and, more particularly, relates to conical composite bushings having an improved floating shield design.

BACKGROUND OF THE INVENTION

Conventional $SF_6$ gas bushings used in high voltage circuit breakers have no significant shielding to alter the distribution of electrical potential lines. They, therefore, have very asymmetrical potential distributions, with most of the external electrical stress located at the base of the bushing.

FIG. 1 shows a longitudinal cross section of a conventional $SF_6$ gas bushing. A high voltage conductor 10 runs through the center of a hollow bushing insulator 12 that forms a housing around the high voltage conductor 10. The bushing insulator 12 is typically formed with weather sheds 13 on the outer surface of the bushing insulator 12. Weather sheds 13 are described in more detail below. A ground potential grading shield 14 (hereinafter "ground shield") is often mounted at the base of the bushing at flange 16. Flange 16 is used to connect the bushing to ground through a tank assembly (not shown) of the circuit breaker.

FIG. 2 shows an electric field plot of a conventional gas insulated bushing. As shown in FIG. 2, conventional bushings have a very asymmetrical electrical potential distribution along the outside surface of bushing insulator 12 (i.e., non-parallel potential lines) and high electrical stress throughout the bushing as indicated by the closely spaced potential lines. The voltage at which a flashover occurs is related to the bushing's voltage withstand capability. The highest electrical stress is produced at the base section of the bushing as shown in FIG. 2. The higher the electrical stress, the lower the voltage withstand capability of the bushing. Thus, the ground shield 14 provides the bushing only minimal protection from electrical breakdown in the portion of the bushing subject to the highest electrical stress. Failure of conventional bushings to shield other portions of the bushing insulator subject these insulators to high electrical stress which reduces the bushing's voltage withstand capability.

$SF_6$ breaker bushings are an integral part of the breaker, both electrically and mechanically. They are not designed or used as general purpose apparatus bushings. $SF_6$ breaker bushings are designed to support and insulate high voltage line connections and carry power into the grounded tank of the circuit breaker.

In high voltage circuit breakers, the pairs of bushings for each phase of the circuit protected by the breaker are often mounted so that their ends have a greater spacing than their bases to avoid breakdown between the exposed conductive ends of the bushings. One means for achieving the desired spacing has been to use conical bushings such that the terminal ends of the bushings have smaller diameters than their respective bases. For example, FIG. 3 shows a high voltage circuit breaker with conical bushings 20*a–c* and 22*a–c*. The conical bushings are angled away from each other to provide an adequate air gap (AG) between their ends so that in the event of a flashover or significant current leakage, the resulting breakdown is grounded in one of the dead tanks 23 of the dead tank assembly 24. As circuit breakers become more compact, the size and spacing of the bushings become a critical design feature of the circuit breaker.

The weather sheds 13 (FIG. 1) on the external surface of the bushing insulator 12 resist the effects of rain and surface dirt to maintain good dielectric conditions and thereby reduce the potential of a flashover or leakage. Bushing insulators including the weather sheds have been made from porcelain or a cast epoxy. Typically, these weather sheds are designed so that water rolls off the sheds keeping the underside of the sheds substantially dry. However, a significant portion of the insulator surface can become wet or degraded by environmental pollution. The resulting weakening of the dielectric field can cause leakage and flashover conditions.

An additional drawback of porcelain or cast epoxy bushings is that they are relatively brittle and, therefore, are subject to damage from external conditions that can cause them to shatter so that the $SF_6$ contained therein explodes. To provide an optimal insulator and a safe and reliable housing for the bushing conductor, the porcelain and cast epoxy insulators are produced with a relatively thick wall (i.e., about 1 inch). The increased thickness further narrows the air gap, increases the weight of the bushings, and increases the cost of the bushings.

Therefore, a composite bushing has been developed that provides the following advantages over traditional bushings: non-brittle behavior, reduced weight and wall thickness, pollution resistance, and improved wet electrical capability. A longitudinal cross section of a composite bushing is shown in FIG. 4. Composite bushings insulators are made up of a fiberglass reinforced tube 30 protected by a silicone rubber housing 32. These bushings have a straight cylindrical composite tube with aluminum end flanges 40 and 42 and room temperature, vulcanized (RTV) silicone rubber weather sheds 33. The RTV silicone rubber has a hydrophobic surface due to oil films that naturally form on the rubber surface.

A grading shield 36 is provided at the base of the bushing mounted to the flange 40 and grades the high electrical potential stress in that region as explained above. A second top end grading shield 38 is also typically required in cylindrical composite bushings to drive the voltage down from the top section of the housing to reduce the risk of breakdown between two bushings of the circuit breaker. The addition of a second shield increases the cost and weight of the bushing and adds further steps to the assembly of the bushing.

The composite bushings are produced by using an injection molding technique in which a single mold forms a single section of the housing 32 at a time. This process is both time consuming and relatively inefficient in that each section of the housing must also be molded together to form the completed insulative housing. Since the insulative housing is formed from an injection molding process, a specially designed mold would be required to produce the desired conical shape. For many high voltage breakers that require very large bushings, such molds are impractical.

A process for molding rubber using a traveling mold has been developed. Essentially, the traveling mold is capable of forming plastic or rubber on substantially any shape in a continuous process. Therefore, to improve the performance and reduce the size, weight and number of parts of high voltage bushings there is a need to design a conical composite bushing that has an insulative housing which can be formed using such a traveling mold. In addition, there is a need to grade the high electrical stress over a greater portion of the bushing.

Floating shields and foils, have been employed for the purpose of dividing the voltage into sections, resulting in a forced, more symmetrical electrical potential distribution on the outside of the insulator. This more symmetrical, potential distribution (i.e., parallel graded potential lines) results in lower electrical stress and, therefore, a higher voltage withstand capability. The floating shields also result in a more symmetrical potential distribution inside the insulative housing, which results in lower electrical stress. This lower internal stress can allow smaller diameter bushings for the same voltage withstand level, when compared to conventional bushings.

One example of a conventional bushing utilizing a floating shield is shown in FIG. 5. As shown in the figure, an epoxy insulator 50 is provided between the high voltage conductor 52 and the interior wall of the hollow housing 54. The epoxy insulator 50 is used to support a floating shield 56 disposed along the high voltage conductor 52 and between the conductor 52 and the epoxy insulator 50. The epoxy insulator 50 comprises a number of sections that are connected together at joints 58 and 59. It should be understood from the potential lines shown in FIG. 2, that the epoxy insulator 50 is placed in a very highly stressed area of the bushing. Thus, the joints 58 and 59 at which the sections of the epoxy insulator are joined must be nearly perfect to avoid electrical failure of the bushing. Moreover, the epoxy insulator requires mounting at both the top end 57 and at its base 60. The epoxy insulator shown in FIG. 5 is critically stressed in high voltage applications and may, therefore, be subject to reliability problems. Therefore, although this floating shield is capable of grading a greater portion of the bushing than the ground shield shown in FIG. 1, its assembly requires precision and several additional parts thereby increasing its cost and reducing its reliability.

Foil shield designs typically employ solid "cores" of layered epoxy and foils, or foil/paper/oil cores. These designs can effectively force symmetrical field distributions to grade the potential lines in bushings radially, but also force high stresses onto solid insulation. In particular, the solid insulation (paper impregnated with oil) is located between the foils of non-magnetic metals in highly stressed areas. If any airpockets or other debris are left in the layered foils, the performance of the bushing can be critically degraded. Accordingly, these foil shields require extensive precision and are also costly to produce.

Therefore, there is a need to provide a high performance shielded bushing having an optimal voltage withstand capability achieved by optimizing the weather and environmental tolerance of the bushing and reducing the electrical stress on the bushing's insulative housing while minimizing the size, weight, cost, and complexity of the bushing.

SUMMARY OF THE INVENTION

An objective of the present invention is to improve the stress distribution (i.e., make the distribution more symmetrical) by introducing a floating potential shield in a midsection of the gas insulation gap of the bushing and by improving the weather and pollution resistance of the bushing housing. This is accomplished in the present invention by preferably including a unique supporting system in which the supporting insulators are located outside the higher stressed areas of a conical composite bushing.

In particular the present invention fulfills the above stated needs by providing a high voltage bushing comprising: a ground shield disposed within a housing for substantially shielding a base section of the housing; and a floating shield disposed within the housing for substantially shielding a middle section of the housing. A support means is preferably disposed between the ground shield and the housing for supporting the floating shield. The floating shield is preferably connected to the support means at a location within the housing in which the electrical stress is substantially lower than the electrical stress at the base of the housing.

In a preferred embodiment, the bushing has a conical shape. More preferably, the housing comprises: a protective inner tube; and an outer insulator having a plurality of weather sheds. The protective inner tube is preferably made of a fiber reinforced material. The outer insulator is preferably made of silicone rubber.

In another preferred embodiment, a number of floating shields are provided for shielding the housing along different elongated portions of the housing. The support means is preferably disposed between the ground shield and the housing and extends from the base of the housing to a predetermined point within the housing so that each of the floating shields are supported by the support means in series. Preferably, the floating shields are connected to the support means at locations within the housing in which the electrical stress is substantially lower than the electrical stress at the base of the housing.

A composite shielded gas bushing for protecting a high voltage interface formed by a conductor connected between a switch and a high voltage circuit is also provided by the invention. According to the invention, the composite shielded bushing comprises: a hollow tube; an insulative housing surrounding the hollow tube; and a conductive shield disposed within the hollow tube for shielding the insulative housing from the base of the hollow tube to a predetermined point corresponding to a middle section of the housing. The predetermined point is preferably selected to optimize the voltage withstand capability of the bushing.

In a preferred embodiment, the conductive shield comprises: a ground shield disposed within the housing for substantially shielding a base section of the insulative housing; and at least one floating shield disposed within the housing for substantially shielding the insulative housing from a location corresponding to the base of the insulative housing to the predetermined point. In this preferred embodiment, a support means is disposed between the ground shield and the insulative housing and extends from the base of the insulative housing to the predetermined point so that each of the floating shields is supported by the support means in series to substantially shield the housing over the length of the support means.

In a more preferred embodiment, the hollow tube and the insulative housing have a conical shape. The hollow tube is preferably made of a fiber reinforced material. The insulative housing is preferably made of silicone rubber. In a more preferred embodiment, the insulative housing has a plurality of weather sheds forming a helix thereon.

BRIEF DESCRIPTION OF THE DRAWINGS

The present invention will be better understood, and its numerous objects and advantages will become apparent by reference to the following detailed description of the invention when taken in conjunction with the following drawings, in which.

DETAILED DESCRIPTION OF THE INVENTION

Figure 1:
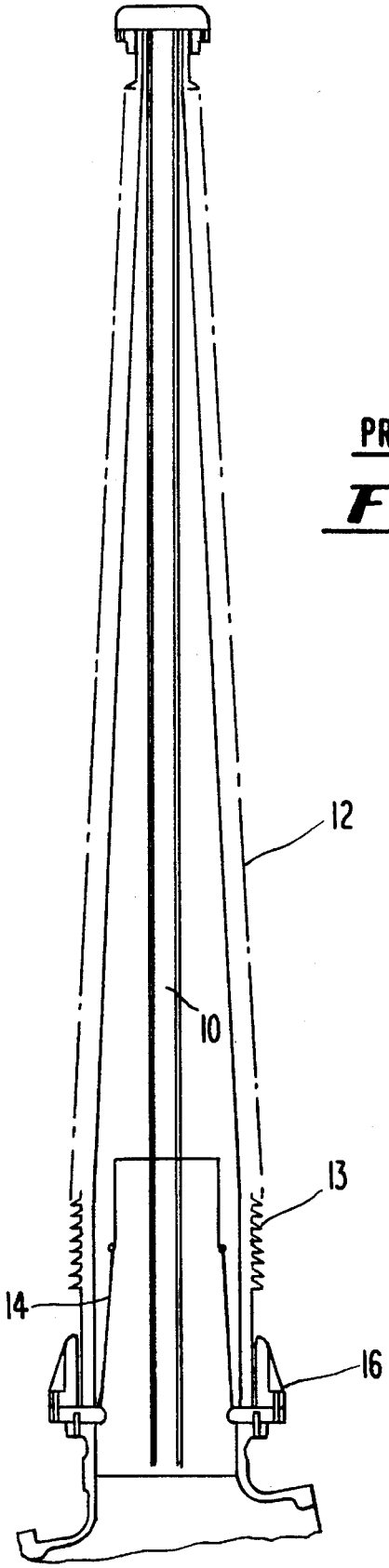
PRIOR ART Fig. 1
FIG. 1 shows a longitudinal cross section of a conventional $SF_6$ gas bushing.
Figure 2:
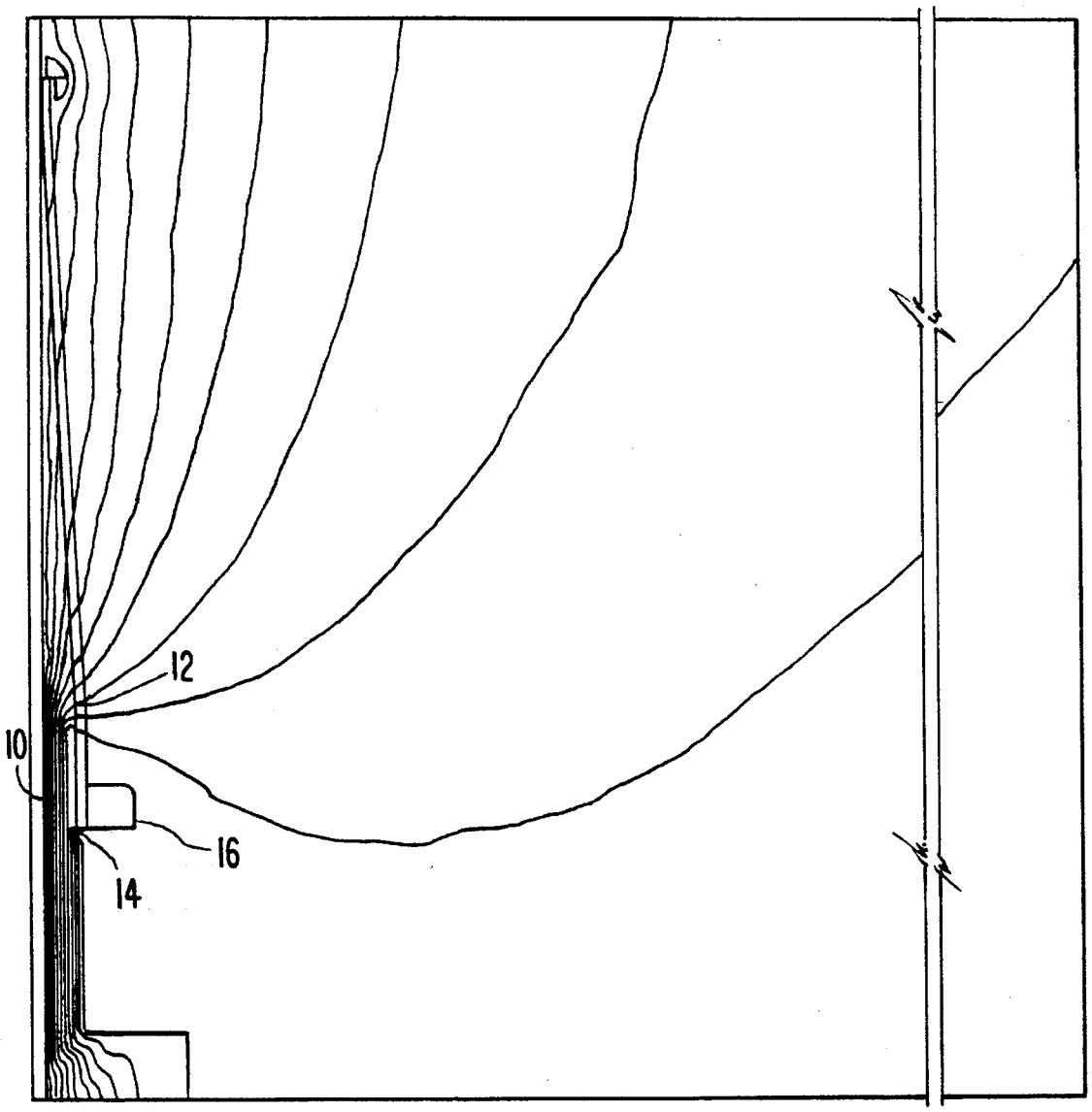
PRIOR ART Fig. 2
FIG. 2 shows an electric field plot of a conventional gas insulated bushing.
Figure 3:
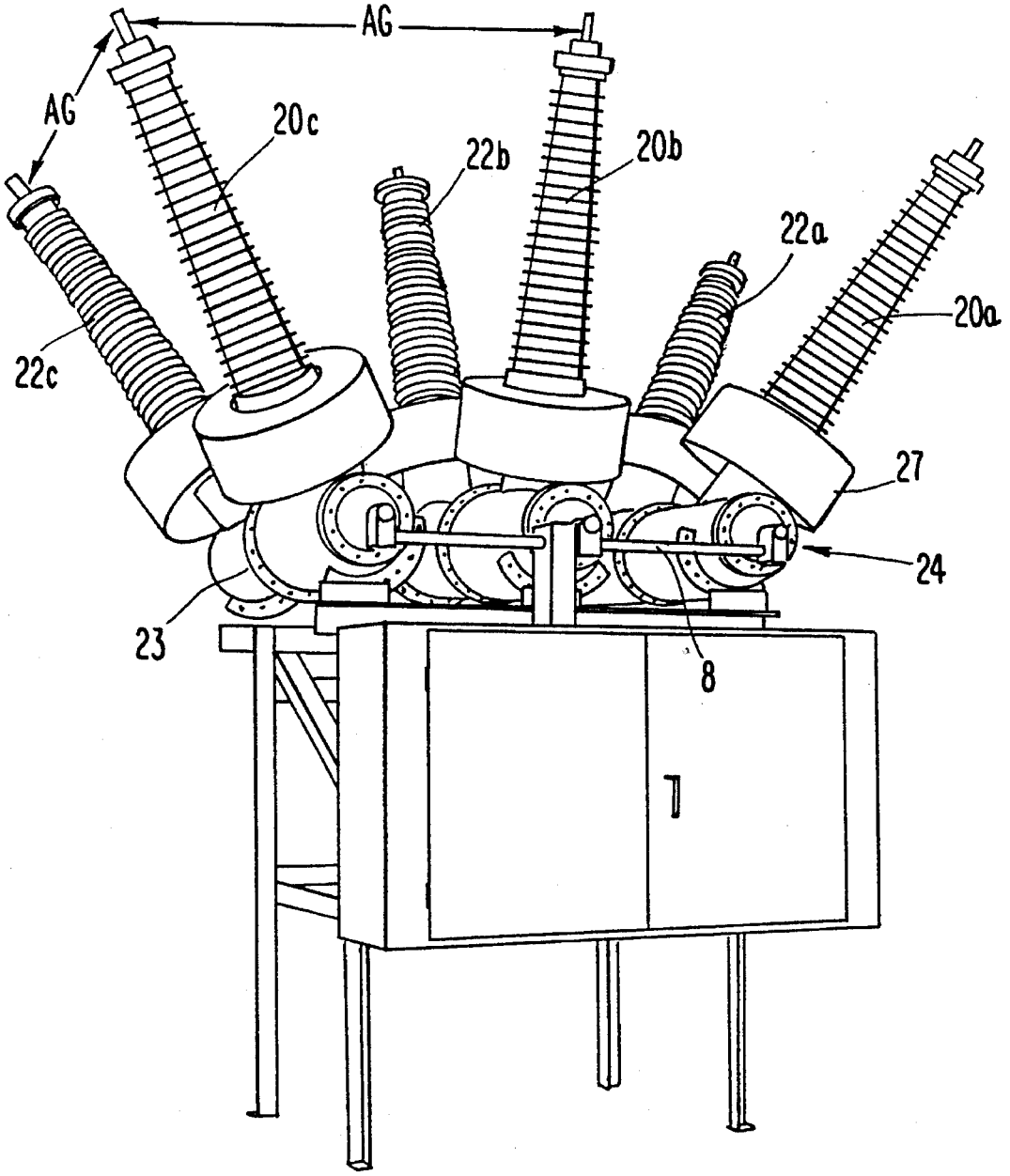
PRIOR ART Fig. 3
FIG. 3 shows a high voltage circuit breaker with conical bushings.
Figure 4:
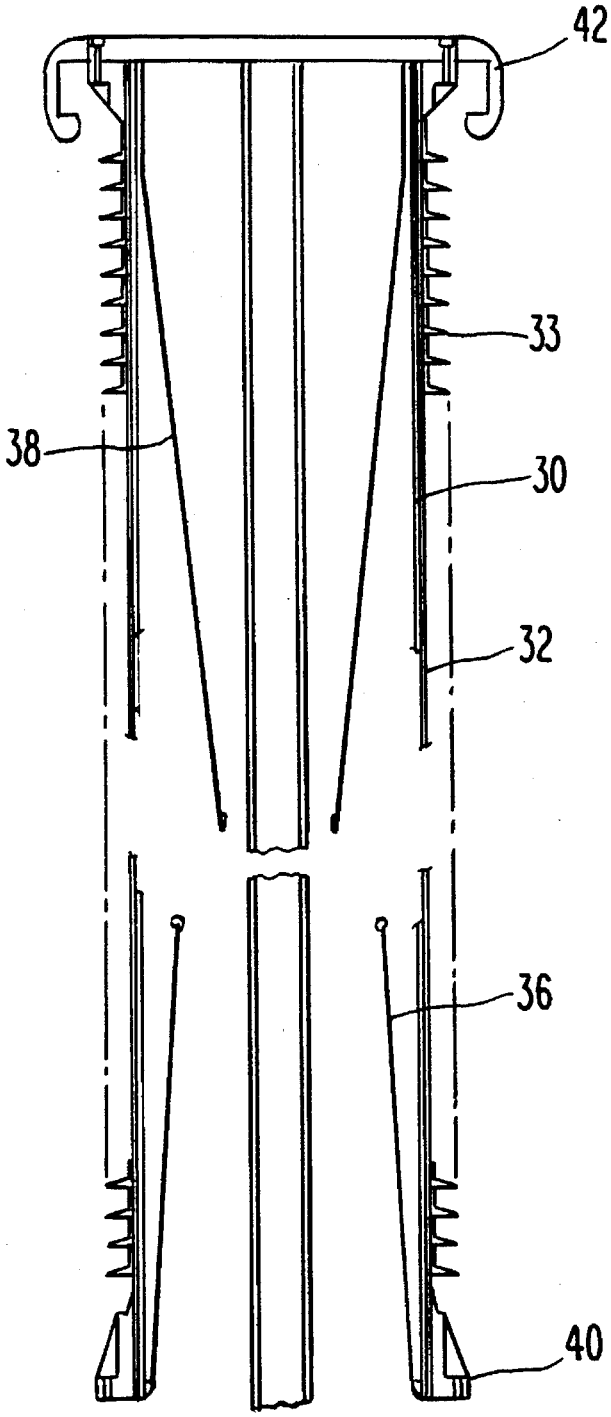
PRIOR ART Fig. 4
FIG. 4 shows a longitudinal cross section of a composite bushing.
Figure 5:
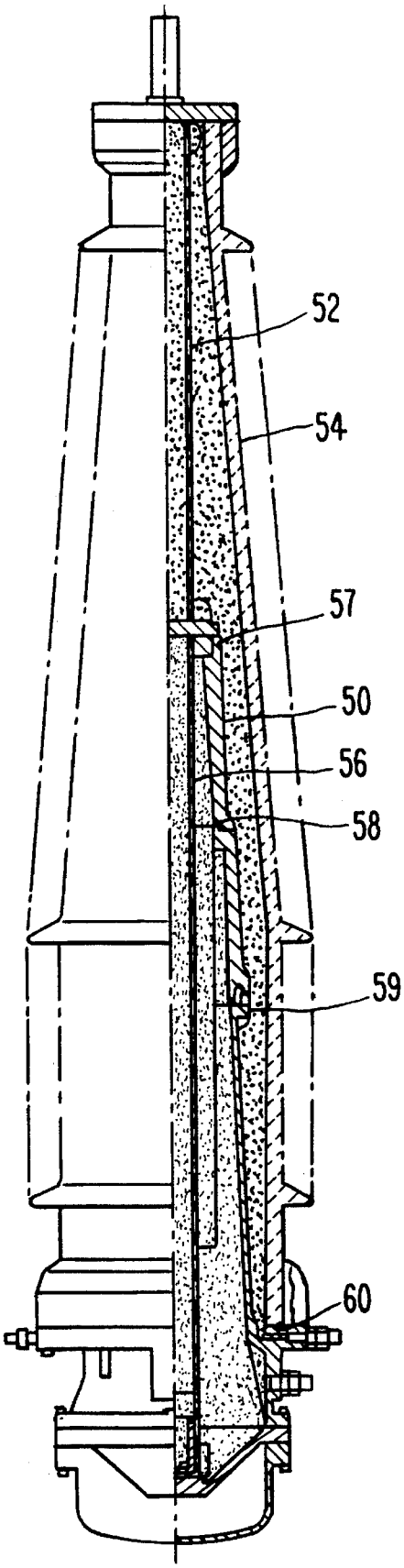
PRIOR ART Fig. 5
FIG. 5 shows a conventional bushing utilizing a floating shield.
Figure 6:
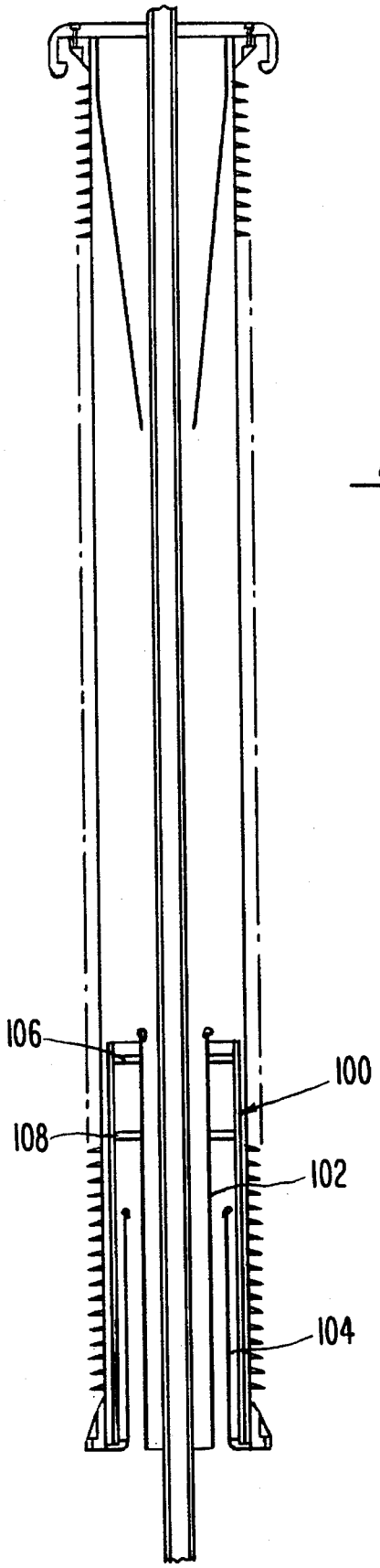
FIG. 6 shows a longitudinal cross section of a high voltage cylindrical composite bushing according to the invention.

FIG. 6 shows a longitudinal cross section of a high voltage cylindrical composite bushing according to the invention. It should be understood that the invention is not limited to composite bushings, nor is it limited to cylindrical bushings. According to the invention the supporting insulator 100 is disposed outside of the high stress region between the floating and ground potential shields 102 and 104 respectively. Improved electrical stress distribution is thereby achieved without critically stressing the supporting insulation 100.

Figure 7:
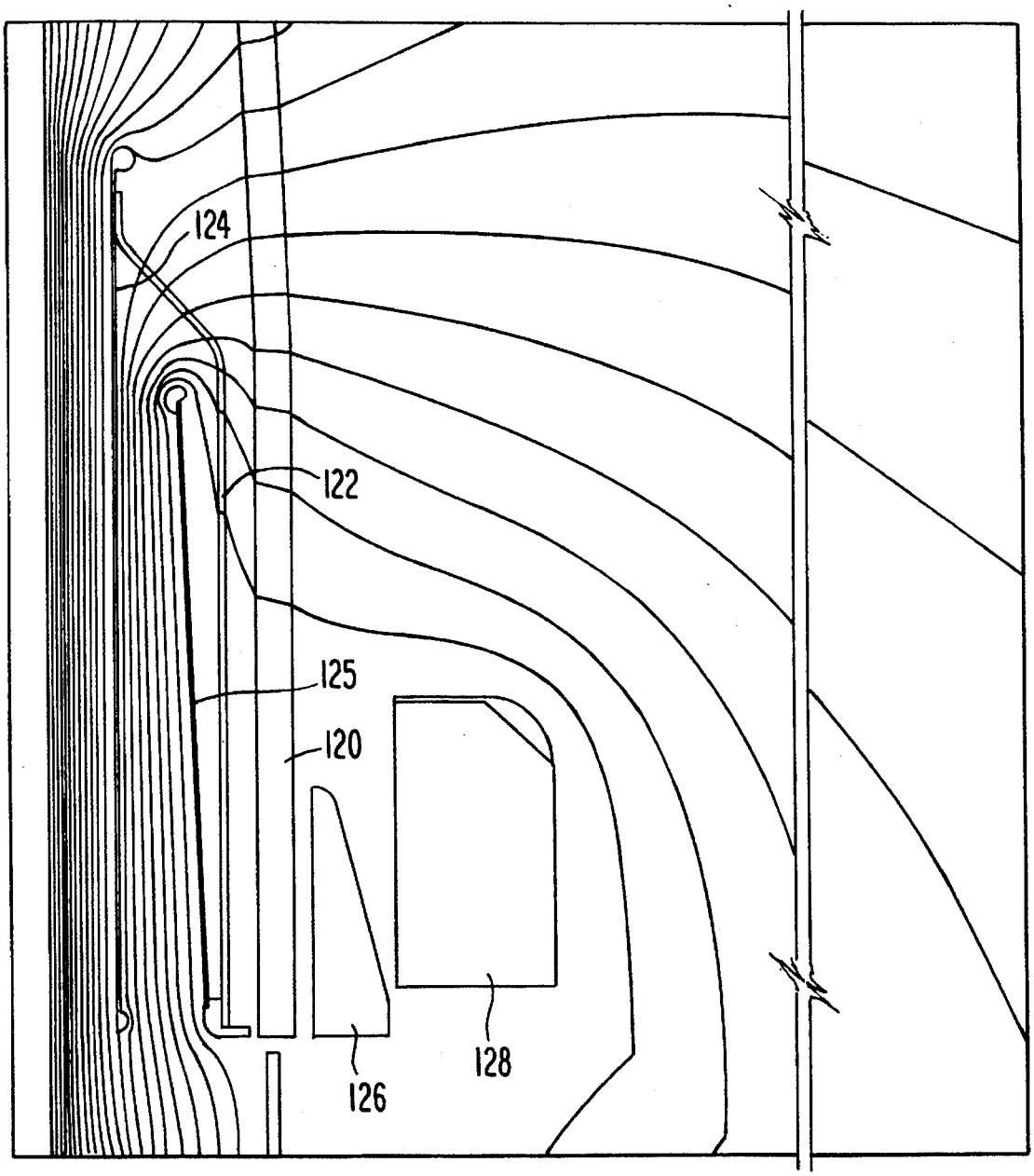
FIG. 7 shows an electric field plot of the base and a mid section of the bushing according to the invention.

FIG. 7 is an electric field plot of the base and middle section of the bushing according to the invention. In this example, an alternative embodiment of the invention is depicted in which the insulative housing 120 has a conical shape and the supporting insulator 122 is angled above the ground shield 125 towards the floating shield 124. The combination of floating and ground shields more uniformly grade the electrical field both radially from the conductor outward to the shield and longitudinally along the insulator. The resulting electrical stresses are thus reduced about 10 to 20 percent, both internally inside the insulator and externally in the air along the insulator. It should be understood that depending upon the shape and size of the insulative housing, the ground and floating shields may be cylindrical or conical in shape to provide a desired electrical potential over the shielded sections of the insulative housing.

In a preferred embodiment, a plurality of upper posts 106 and lower posts 108 (FIG. 6) extend from the floating shield with a terminal bolt. The supporting insulator 100 preferably provides corresponding holes (not shown) for receiving one of the bolts so that the floating shield 102 is suspended from the supporting insulator 100. Since, the supporting insulator is located in a low electrical stress region of the bushing, the means for connecting the floating shield to the supporting insulator are not critical. Therefore, standard hardware can be used for the posts 106 and 108. Moreover, the precision of the connection is not critical in the low stress region so the holes in the supporting insulator can be formed by a simple punch process. While posts with terminal bolts have been illustrated and described as a means for suspending the floating shield to the supporting insulator, it should be understood that the floating shield can be supported by the supporting insulator in numerous ways. For instance, if the supporting insulator is bent as shown in FIG. 7, the floating shield 104 can simply be glued to the supporting insulator 124.

The floating shield designs shown in FIGS. 6 and 7 includes a single floating shield at approximately 50% potential. However, it should be understood that a floating shield according to the invention can be lengthened or shortened relative to the size of the bushing to provide shielding between approximately 25% and 75% electrical potential. Moreover, the supportive insulator can easily be extended to include multiple floating shields set at different floating voltage levels, i.e. so that they are arranged in a serial chain or with overlapping sections. The number of floating shields is dependent upon the particular requirements and application of the bushing design. It should also be understood, that a corresponding number of separate supporting insulators can be placed in the low stress region between the ground shield and the bushing housing so that each floating shield can be supported by its own supporting insulator.

Figure 8:
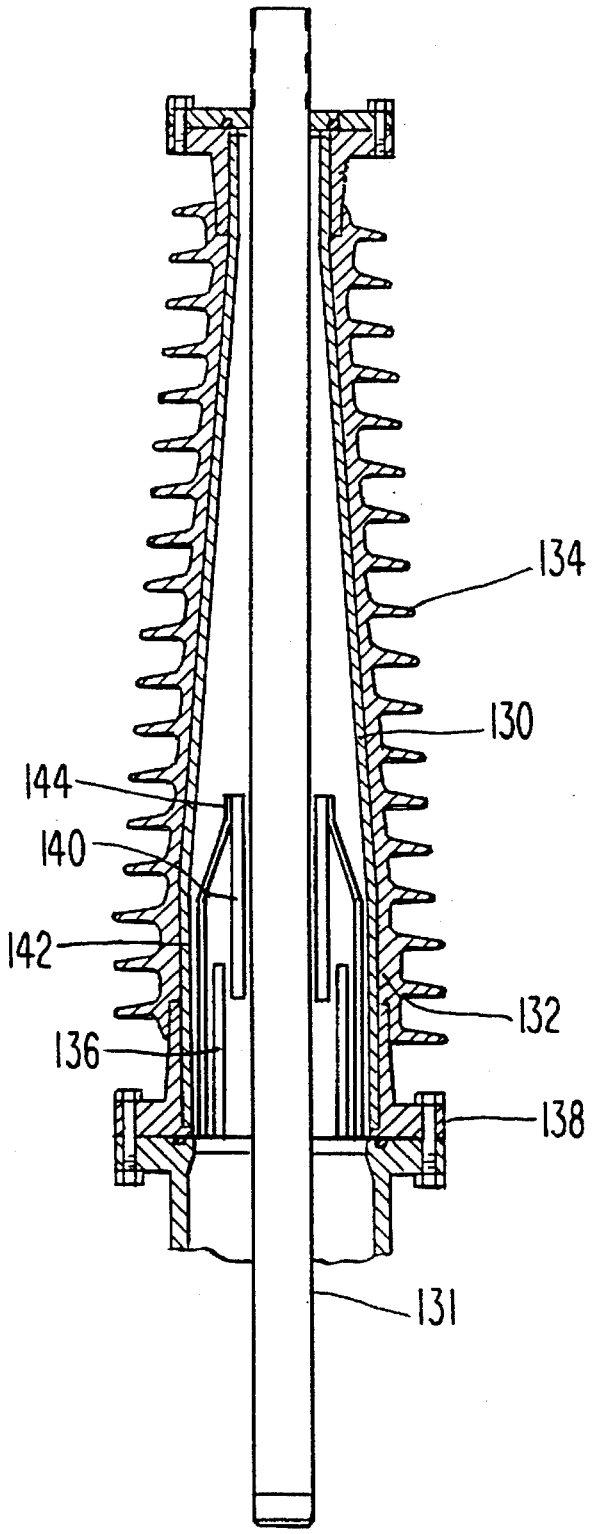
FIG. 8 shows a longitudinal cross section of a conical composite bushing incorporating the floating shield according to the present invention.

To further improve the voltage withstand capability, it is preferable to use the floating shield arrangement according to the invention in a conical composite bushing. FIG. 8 is a longitudinal cross section of a conical composite bushing incorporating the floating shield according to the present invention. A conical fiber reinforced tube (FRP) 130 surrounding the bushing conductor 131 is formed from an epoxy resin or polyester material which has been reinforced with a strong fibrous material such as fiberglass, polyesters, aramids, or cloth threads. The traveling mold described above is used to form an insulative housing 132 having weather sheds 134 of silicone rubber or a similar rubber material such as ethylene propylene on the surface of the conical FRP tube 130. The weather sheds 134 preferably form a helix along the bushing surface. A ground shield 136 is attached to the inner surface of the FRP tube 130 and mounting flange 138 as shown in FIG. 8. A floating shield 140 is suspended from a supporting insulator 142. The supporting insulator 142 is bent above the ground shield 136 towards the conductor 131 and provides a mounting surface 144 on which the floating shield is mechanically mounted, e.g., bolted, screwed, glued, etc.

It should be understood that the improved floating shield can be utilized in bushings using any insulating gas or liquid, and is not to be limited to $SF_6$. While conical composite bushings according to the invention are preferred, it should be further understood that the use of a floating shield in both conventional porcelain and composite insulator designs provides many advantages as described above.

While the invention has been described and illustrated with reference to specific embodiments, those skilled in the art will recognize that modification and variations may be made without departing from the principles of the invention as described hereinabove and set forth in the following claims.

What is claimed:

1. A high voltage bushing having a hollow elongated insulative housing such that a high voltage conductor can be longitudinally disposed within said housing, the bushing comprising:

a ground shield disposed within said housing for substantially shielding a base section of said housing;

a floating shield disposed within said housing for substantially shielding a middle section of said housing;

a support means at least partly disposed between said ground shield and said housing for supporting said floating shield; and means for connecting said floating shield to said support means at a location within said housing in which the electrical stress is substantially lower than the electrical stress in unshielded areas of the base and middle sections of the bushing.

2. The bushing of claim 1, wherein said bushing has a conical shape.

3. The bushing of claim 1, wherein said housing comprises:

a protective inner tube; and an outer insulator having a plurality of weather sheds.

4. The bushing of claim 3, wherein said protective inner tube is made of a fiber reinforced material.

5. The bushing of claim 3, wherein said outer insulator is made of silicone rubber.

6. The bushing of claim 3, wherein said bushing has a conical shape.

7. The bushing of claim 1, further comprising:

a number of floating shields for shielding said high voltage conductor along different elongated portions of said housing.

8. The bushing of claim 7, wherein said support means is disposed between said ground shield and said housing and extending from the base of said housing to a predetermined point within said housing, each of said floating shields being supported by said support means in series so that said housing is substantially shielded over the length of said support means.

9. The bushing of claim 8, wherein said floating shields are connected to said support means at locations within said housing in which the electrical stress is substantially lower than the electrical stress at the base of said housing.

10. A composite shielded gas bushing for protecting a high voltage interface formed by a conductor connected between a switch and a high voltage circuit, comprising:

a hollow tube having a base opening and a top opening, said conductor capable of passing through said openings;

an insulative housing surrounding said hollow tube;

a conductive shield disposed within said hollow tube for shielding said insulative housing from the base of said hollow tube to a predetermined point corresponding to a middle section of the housing; and a support member connected to said conductive shield at a location within said housing in which electrical stress is substantially lower than the electrical stress in the unshielded areas in said bushing between said base opening and said predetermined point.

11. The bushing of claim 10, wherein said predetermined point is selected to optimize the voltage withstand capability of the bushing.

12. The bushing of claim 10, wherein said conductive shield comprises:

a ground shield disposed within said housing for substantially shielding a base section of said insulative housing;

and at least one floating shield disposed within said housing for substantially shielding said insulative housing from a location corresponding to the base of said insulative housing to said predetermined point.

13. The bushing of claim 12, wherein each of said floating shields is supported by said support means in series so that said insulative housing is substantially shielded over the length of said support means.

14. The bushing of claim 10, wherein said hollow tube and said insulative housing have a conical shape.

15. The bushing of claim 10, wherein said hollow tube is made of a fiber reinforced material.

16. The bushing of claim 10, wherein said insulative housing is made of silicone rubber.

17. The bushing of claim 10, wherein said insulative housing has a plurality of weather sheds formed thereon.

18. The bushing of claim 17, wherein said weather sheds form a helix.

* * * * *

UNITED STATES PATENT AND TRADEMARK OFFICE

CERTIFICATE OF CORRECTION

PATENT NO. : 5,466,891

DATED : November 14, 1995

INVENTOR(S) : Willie B. Freeman et al.

It is certified that error appears in the above-indentified patent and that said Letters Patent is hereby corrected as shown below:

At column 5, line 67, "shield 104" should be --shield 124--.

At column 6, line 1, "124" should be --122--.

Signed and Sealed this

Thirtieth Day of April, 1996

*Attest:*

*Attesting Officer*

BRUCE LEHMAN

*Commissioner of Patents and Trademarks*